United States Patent [19]

Schmidlin

[11] Patent Number: 4,471,589

[45] Date of Patent: Sep. 18, 1984

[54] WINDOW OR DOOR

[75] Inventor: Hans Schmidlin, Aesch, Switzerland

[73] Assignee: Eltreva AG, Aesch, Switzerland

[21] Appl. No.: 395,059

[22] PCT Filed: Jan. 28, 1982

[86] PCT No.: PCT/EP82/00014

§ 371 Date: Jun. 17, 1982

§ 102(e) Date: Jun. 17, 1982

[87] PCT Pub. No.: WO82/02572

PCT Pub. Date: Aug. 5, 1982

[30] Foreign Application Priority Data

Jan. 29, 1981 [DE] Fed. Rep. of Germany ..... 3102921

[51] Int. Cl.[3] ..... E06B 3/24; E06B 3/66

[52] U.S. Cl. ..... 52/171; 52/304; 52/399

[58] Field of Search ..... 52/171, 172, 397, 398, 52/304, 399, 788, 464

[56] References Cited

U.S. PATENT DOCUMENTS

| | | | |
|---|---|---|---|
| 3,081,849 | 3/1963 | Hubbard | 52/397 X |
| 3,093,217 | 6/1963 | Doede | 52/397 X |
| 3,308,588 | 3/1967 | Von Wedel | 52/397 X |
| 3,694,984 | 10/1972 | Schwartz | 52/398 |
| 3,837,126 | 9/1974 | Voiturier et al. | 52/171 X |
| 3,981,111 | 9/1976 | Berthagen | 52/171 |
| 4,132,218 | 1/1979 | Bennett | 52/304 X |
| 4,187,657 | 2/1980 | Sukolics | 52/397 |

FOREIGN PATENT DOCUMENTS

| | | | |
|---|---|---|---|
| 1534773 | 9/1969 | Fed. Rep. of Germany | 52/398 |
| 2004559 | 8/1970 | Fed. Rep. of Germany | 52/399 |
| 2245106 | 3/1974 | Fed. Rep. of Germany | 52/304 |
| 1299744 | 6/1962 | France | 52/303 |
| 461758 | 10/1968 | Switzerland | 52/397 |
| 1406537 | 9/1975 | United Kingdom | 52/397 |

*Primary Examiner*—J. Karl Bell

*Attorney, Agent, or Firm*—Michael J. Striker

[57] ABSTRACT

A window or door structure consists of a support frame and a retaining frame positioned thereabove mounted by means of frame connection elements and also includes a multiple insulating glass supported by these two frames, the weight of the glass being absorbed by the support frame. The glass engages a longitudinal bar of the support frame as well as a longitudinal bar of the retaining frame with its edge by an intermediary pane gasket.

The retaining frame is displaceably mounted on the support frame by means of the frame connection elements vertically with respect to the frame plane.

The two pane gaskets are provided, which form a steam tight closure on the total pane circumference.

A frame sealing profile is positioned between the two frames which bridges the displacement slot between the two frames, having an expansion fold, or the like, which permits the displacement or has a compensating elasticity, thus closing the intermediary air space between the two glass panes over the total frame circumference steam tight against the outer atmosphere.

34 Claims, 13 Drawing Figures

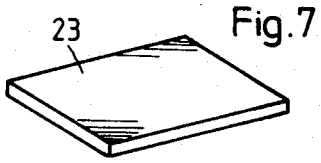
Fig.7
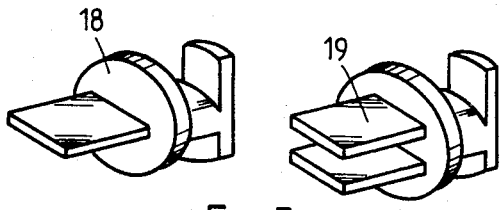
Fig.5
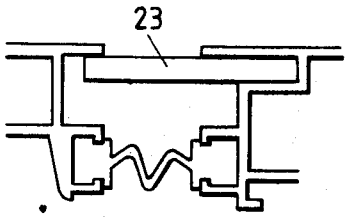
Fig.6
Fig.4
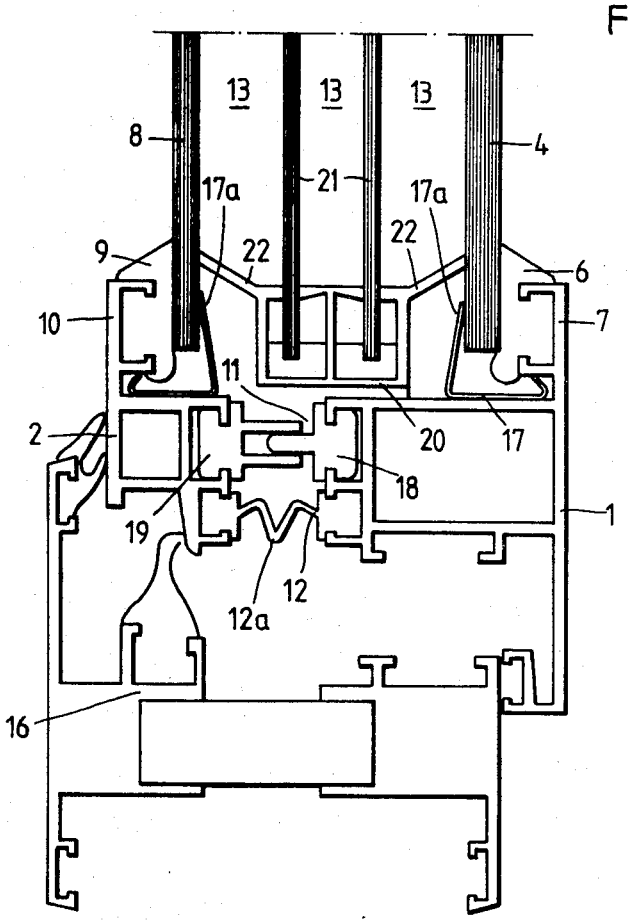

WINDOW OR DOOR

BACKGROUND OF THE INVENTION

The invention relates to a window or door, structure consisted of a support frame, a retaining frame positioned thereabove and mounted thereto by means of frame connection elements and a multiple insulating glass supported by these two frames, the weight of the glass being absorbed by the support frame. The glass engages a longitudinal bar of the support frame as well as a longitudinal bar of the retaining frame with its edge by providing an intermediary pane gasket.

Such a structure is disclosed in DE-OS No. 27 12 691, for example. The retaining frame which consists of aluminum profiles as a unitary element is connected with the unitary support frame, which is also assembled of aluminum profiles, by means of clamping parts which form the frame connecting elements. The latter consist of plastic, for example, and are fixedly mounted in a groove of the retaining frame at a distance from each other and engage with one foot between U-shanks of the support frame, which shanks form a retaining groove and are mounted vertically on the glazing plane. These clamping parts may also be provided with a chrome steel insert.

In this known structure the multiple pane insulating glass consists of a conventional insulation glazing which is provided with a weather side pane and a room side pane which are rigidly and non-detachably connected with each other at the edge area by means of a rigid distance frame which simultaneously closes the intermediary air space enclosed between the two glass panes steam tight with respect to the atmosphere. This intermediary air space normally contains dried air or technical gases under normal pressure.

For assembly purposes, this unitary insulation glazing is inserted in the support frame. Subsequently, the retaining frame which previously has been provided with the clamping elements is inserted with the feet of the clamping elements into the mentioned retaining groove of the support frame under pressure until an automatic locking occurs. Thereby, the retaining frame with its associated pane gasket is pushed with high pressure against the outer side of the weather side glass pane, whereby the insulation glazing with its room side glass pane is firmly pressed against the pane gasket of the mentioned longitudinal bar of the support frame. This pane gasket on the support frame may be a two side adhesive sealing tape, for example.

This known embodiment is also called a pressure glazing.

In such a conventionally designed insulating glazing, the clear distance between the two glass panes is 12 mm, for example. Without considering the dampening value of the air layer, a heat throughput number $k=2.6$ kcal/m$^2$h°C. is stated as the empirical measuring value. This corresponds to a dampening value of $1/k=0.3846$. If one considers the dampening value defined by the enclosed air, one can see that the so-called k-value can be improved by enlarging the pane distance. However, substantial tests have shown that the degree of efficiency of the insulating glazing, i.e., the ratio of theoretically expected and effective insulation is lowered with increasing an intermediary air space due to the stronger air circulation (convection) in the intermediary air space. With respect to further details, we would like to point to "Glaswelt" 8/1980, page 702 to 704.

However, the desire exists to enlarge the pane distance and thereby the intermediary air space in a conventional insulating glazing. However, when realizing this desire, the following problems occur: The temperature fluctuations to which such an insulating glazing is subjected are between −10° and +60° C. Therefore, in an intermediary air space of 12 mm, a volume fluctuation of the enclosed air volume occurs of about 3.08 l/m$^2$ pane face. In an intermediary air space of 16 mm this volume fluctuation already increases to 4.10 l/m$^2$ pane face. Therefore, a larger intermediary air space increases the pumping movements, that is, the so-called double pane effect considerably. Thereby, mechanical stresses of the edge sealing and possible optical distortions are increased. Therefore, the conventional intermediary air space of 12 mm was found to be the optimum between effort, efficiency and pane stresses (a.a.O.)

Furthermore, it is particularly disadvantageous that the outer edge connection of conventional insulating glazings represents a substantial deterioration of the k-value, which is about 5.0 in the edge zone area.

SUMMARY OF THE INVENTION

Based on the aforementioned structure of a window or door, it is an object of the subject invention to enlarge the distance of the two glass panes for improving the k-value, however without increasing the mechanical stresses of the edge sealing of the glass panes and/or putting up with optical distortions caused by a buckling of the glass panes.

This object of the invention is obtained by the following features in accordance with the invention:

(a) the retaining frame is displaceably mounted on the support frame by means of the frame connection elements vertically with respect to the frame plane;

(b) the two pane gaskets form a steam tight closure over the total pane circumference;

(c) a frame profile is positioned between the two frames, which profile bridges the displacement slot between the two frames having an expansion fold, or the like, which permits the displacement or has a compensating elasticity, thus closing the intermediary air space between the two glass panes over the total frame circumference steam tight against the outer atmosphere.

An insulating glass is known from CH-PS No. 584 342, which glass consists of glass panes which are positioned at a distance from each other and are inseparably connected with each other in the edge area by means of gas and liquid tight means, thus forming a closed chamber between the glass panes. Thereby, at least one of the two glass panes is movable around a pivotal axis which extends on the lower edge, so as to compensate for pressure changes in the closed chamber. While in this state of the art the aforementioned problem has been solved by a certain design of the insulating gas itself, the invention shows a completely different way. In accordance with the invention the two glass panes which form the insulation glazing are not undetachably connected with each other for the first time, but two different frame structures are provided which are displaceable relative with respect to each other. The steam tight closure of the air volume enclosed between the two glass panes with respect to the outer atmosphere is not performed by one of the sealings which connect the two glass panes immediately and inseparably with each other, in accordance with the invention. In accordance with the invention, three gaskets are provided, first of all the pane gaskets, which are also known from the known window or door, as well as the frame sealing profile which is used for the first time, with which the displacement slot between the two frames is bridged.

In a specific embodiment the two glass panes can be suppported by means of the respective pane gasket on one each glass bar mounted in intermediary air space. Thereby, the one glass bar is mounted on the retaining frame and the other glass bar is mounted on the support frame. In this structure one can then place the frame sealing profile between the two mentioned glass bars. However, this structure is relatively expensive, but it is advantageous that the two glass panes can be installed without removing the frame sealing profile.

Glass retaining elements may also be provided which retain one glass pane in the retaining frame and the other glass pane in the support frame and press them against the associated pane gasket. Thereby, the retaining frame may be provided with the glass retaining elements for one glass pane and the support frame may be provided with the glass retaining elements for the other glass pane. However, the glass retaining elements may be provided in a frame structure encompassing the support and retaining frame. In this case, the two glass panes with the associated glass bars within the intermediary air space may be connected with each other by an adhesive, for example, butyl rubber. Thereby, the inventive structure can be mounted in an all encompassing frame structure. The inventive glass retaining elements may be claws, hinges, or the like, which are under spring tension and which are supported on those sides of the two glass panes which face the intermediary air space. However, when the retaining and support frames are provided with the glass retaining elements, the latter may be preferably spring bars consisted of chrome steel which engage against the side of the glass pane facing away from the associated pane gasket. Principally, the glass retaining elements may also consist of neoprene bars, or the like. Furthermore, it is also possible to mount the glass panes in a fold which is provided in the retaining or the support frame, whereby this fold is filled with silicon.

For example, the frame connecting elements may be claws or hinges, for example. However, they also may be spring bars V-shaped in their cross section. This design has the advantage that during the parallel installation of the retaining frame no friction forces occur with respect to the support frame. However, it is also possible that the frame connecting elements are provided with a plug in element on one of the two frames, which frame is slidingly guided in a guiding element which is provided on one of the other frames. Thereby, the plug in element and the guiding element may represent an integral part of the frame; however, they also may represent separate parts, made of plastic, for example, which are mounted on the two frames.

In accordance with the invention, the frame connecting elements may be so designed that the retaining frame engages over or under the support frame with a sliding shank. Thereby, rollers, balls, or the like, may be provided between the relatively opposite moving frame parts.

The frame sealing profile as well as the frame connection elements must not necessarily consist of separate structural parts. They may be integrated into one unitary structural element. For example, this can consist of a steel spring which connects the two frames with each other and which is vulcanized into a sealing profile. The steel spring absorbs the forces exerted by the retaining frame (own weight, suction and pressure stresses caused by wind, or the like,) and transmits them to the support frame. The mentioned unitary structural part could also encompass the retaining basket.

Furthermore, the possibility exists that the retaining frame, the support frame and the frame sealing profile are commonly formed by a unitary plastic element.

In accordance with the invention an abutment may be provided which limits the maximum displacement path of the retaining frame with respect to the support frame to the outside and/or the inside.

It had been noted herein above that a disadvantageous air circulation occurs at a larger intermediary air space or pane distance. Due to this air circulation an undesirable heat transmission is generated from the inner side of the room to the outside weather side. This effect becomes stronger, the lower is the friction between these two air layers with respect to each other, that is, the larger the intermediary air space becomes (a.a.O). Therefore, in accordance with the invention, the possibility exists to position one or a plurality of transparent panes, plastic plates or braced foils parallel to the frame plane in the intermediary air space of the glazing. Thereby, a division of the intermediary air space into a plurality of relatively small air chambers is obtained and thereby a considerable reduction of the disadvantageous convenction. Thereby, no separate sealing is required for the additionally positioned panes. The transparent panes may be placed with their edges into a retaining basket, for example, which can consist of plastic, for example, and is inserted into the intermediary air space. Thereby, the support frame may be designed in one piece with the retaining basket. Instead of the retaining basket, one may use local distance spacers which are inserted, during the horizontal assembly of the glazing packs, between the panes and are clamped with each other.

The panes, plastic plates or foils mounted in the intermediary air space may be colored, vapor deposited or coated. Furthermore, the intermediary air space of the glazing may be evacuated with dried air, precious or heavy gas mixtures.

In an advantageous embodiment of the invention the retaining and support frame are provided with a circumferential channel which is filled with a moisture absorbing flowable material and is in a gas exchanging connection with the intermediary air space and is provided with at least one gas tight closeable charging and discharging opening which is accessible from the outside. If one sees an upper charge opening and a discharge opening which is mounted on the lower part of the frame, the moisture absorbing material can be pushed out of the mentioned channel by introducing compressed air, for example, and can be replaced by newly filled in material. Normally, the capacity for absorbing moisture in the material is exhausted after 10 years. While a conventional insulating glazing insulation forms a fog formation and must therefore be replaced by a new glazing, the material filler can be replaced in an easy manner in accordance with the subject invention.

In order to design the support and insert frames steam tight in their frame corners, that is, in the miter joint, it is advantageous that angle plates are inserted in the corresponding frame profiles into the corner area of the retaining and/or support frame, which profiles have outwardly extending open sealing grooves in their jacket faces and are in connection with an outwardly accessible sealing mass injection opening and an air discharge opening. The latter serves as a throughflow/-filling control opening. If a circumferential channel is provided during the construction in the mentioned frame for receiving a moisture absorbing material, one should use angle plate which are provided with a continuous hollow space. Advantageously, the mentioned sealing grooves extend circularly around the shanks of the angle plates, so as to assure a sufficient steam tight design.

The support frame may be provided with a protective frame which covers the frame sealing profile to the outside, as well as forming a centering and/or support. Thereby, the protective frame may consist of plastic material, so as to prevent a cold bridge between the retaining and the support frame. However, it is also possible that the protective frame is formed by the frame shanks on the support frame. If the latter consists of aluminum, it is advantageous that the mentioned frame shanks engage displaceably on the support frame by means of a thermal insulation. Furthermore, the free end of the protective frame may form an abutment for the displacement path of the retaining frame.

All of these embodiments have the common substantial advantage that an automatic displacement of the retaining frame occurs with its weather side glass pane vertical to the plane formed by the support frame during a volume change of the air enclosed between the glass panes and/or change of the air pressure in the outer atmosphere. Therefore, these volume and/or pressure changes do not lead to an additional stress in the edge range of the glass panes; an outwardly or inwardly arching of the glass panes is eliminated. The disadvantage mentioned in the literature which discloses a desirable enlargement of the intermediary air space, are completely eliminated with assurance in the inventive structure. In contrast thereto, the suggestion in accordance with CH-PS No. 584 342 does not represent a practical solution, since this known insulating unit cannot be used in a pressure glazing in accordance with DE-OS No. 27 12 691, for example. One would have to develop a completely new frame structure for receiving this insulating unit, whereby the glass pane which is pivotably mounted around its lower edge presents particular problems with respect to sealing and retaining this unit.

Each, even the smallest buckling of the glass panes could only be eliminated, if the displacement of the retaining frame with respect to the support frame would be carried out friction or force free. However, before the actual displacement one must first overcome the forces which are counteractive against such a displacement and which are composed of the frame sealing profile, the frame connecting elements, the protective frame, or the like, it is unavoidable to cause a very minute buckling of the effected glass pane. If the glass pane on the weather side is suddenly admitted by suddenly occuring wind stresses or other mechanical forces, the resulting sudden displacement of the outer glass pane in the direction of the inner glass pane can be absorbed by the arching frame sealing profile which acts as a buffer. However, this arching is not damaging.

The retaining frame as well as the support frame may consist of metal profiles. However, it is basically possible to design the support frame in a wooden frame. Above all, the two frames, as well as all the other components of the structure may consist of plastic.

Normally, the support frame is mounted on the room side, while the retaining frame is located on the weather side. However, a reversed positioning is basically possible. Therefore, the terms "room side" or "weather side" used in the description of the embodiments can be exchanged without leaving the scope of the invention.

A few exemplified embodiments are shown in the drawing schematically as examples in accordance with the invention.

BRIEF DESCRIPTION OF THE DRAWING

FIG. 4 is a sectional view of a window wing in accordance a modified embodiment;

FIG. 5 are perspective views of plug-in and guiding elements, respectively from FIG. 4;

FIG. 6 is a schematic view of a detail from FIG. 4 in a modified embodiment;

FIG. 7 is a perspective view of a detail from FIG. 6;

FIG. 13 is a sectional view through an angle shank.

DETAILED DESCRIPTION OF THE PREFERRED EMBODIMENTS

Figure 1:
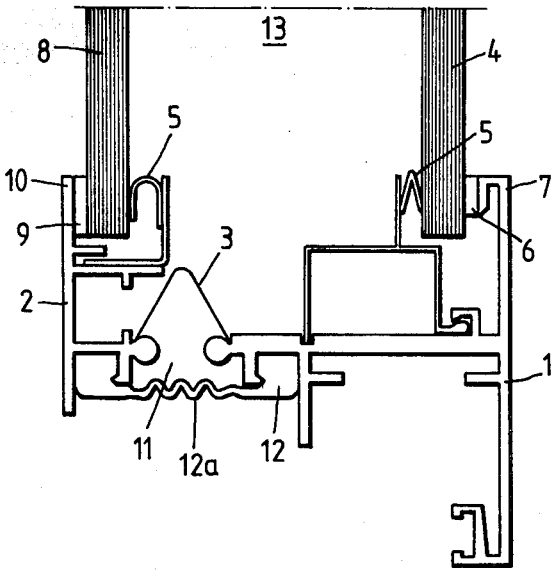
FIG. 1 is a cross sectional view through the lower area of a window wing.

The window wing in accordance with FIG. 1 consists of a room side support frame 1 and a weather side retaining frame 2. The latter is mounted on the support frame 1 in an overhung position and is connected therewith by means of frame connecting elements which in accordance with the embodiment of FIG. 1 consist of a spring bar 3 which has a V-shaped cross section and which is clamped with the frames 1 and 2 by means of correspondingly deflected ends. A room side glass pane 4 is inserted in the support frame 1 which is pushed against a glass pane gasket 6 by means of glass retaining elements in form of V-shaped spring bars 5 made of chrome steel, whereby the glass pane gasket is supported on a longitudinal bar 7. Thereby, the spring bars are supported 5 immediately on the support frame with one V-shank and engage with the other V-shank the side of the glass pane 4 facing away from the pane gasket 6.

A weather side glass pane 8 is inserted in the retaining frame 2 and is retained therein in the same manner as glass pane 4. V-shaped spring bars 5 which function as glass retaining elements push the glass pane 8 against a pane gasket 9 which in turn is supported on a longitudinal bar 10 of the support frame 2. The weight of the weather side glass pane 8, as well as the forces exerted by wind on this glass pane are transmitted through the spring bars 3, which form the frame connecting elements, from the retaining frame 2 to the support frame 1.

The retaining frame 2 has a free space in form of a displacement slot 11 with respect to the support frame 1 bridged by a frame sealing profile 12. The latter is provided with one or a plurality of expansion folds **12*a* and closes the intermediary air space 13 steam tight against the outer atmosphere over the total frame circumference between the two glass panes 4 and 8**.

From FIG. 1 it can be seen that the retaining frame 2 with its weather side glass pane 8 is vertically displaceable with respect to the plane shaped by the support frame 1 or its glass pane 4 against the effect of the spring bars 3, whereby the expansion folds 12*a* of the frame sealing profile 12 compensate for the displacement.

Figure 2:
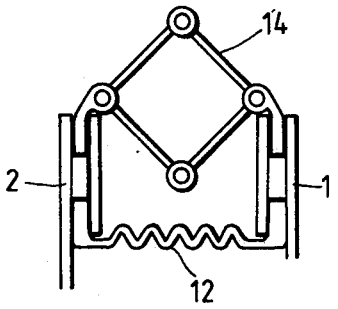
FIG. 2 is a schematic view of frame connecting elements according to a modified embodiment.
Figure 3:
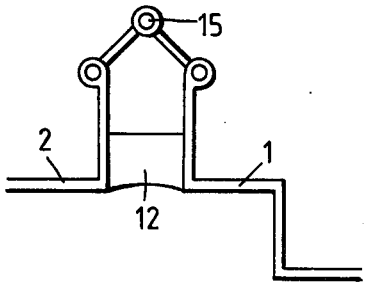
FIG. 3 is a schematic view of a frame connecting element according to a further embodiment.

FIG. 2 shows a modified embodiment of the frame connecting elements, that is, one design in form of a claw 14, while FIG. 3 illustrates a frame connecting element in form of a hinge 15. Furthermore, FIG. 3 shows the frame sealing profile 12 which is provided with a cross sectional taper instead of an expansion fold, which also permits a compensation of the displacement of the retaining frame 2 with respect to the support frame.

FIG. 4 shows a modified window wing in its abutment position on a stationary window frame which is generally designated as 16. With respect to the embodiment of FIG. 1, the glass retaining elements 17 are shaped somewhat differently and which support or engage with a pressure shank 17*a* against the associated pane gasket 6 or 9 and the side of the glass pane 4 or 8 facing away from the pane gasket, and which engage with a second shank on the support or retaining frame by engaging below the glass pane.

The design of the frame connection elements shown in FIG. 4 is also different from that of FIG. 1; the connecting elements preferably consist of plastic plug-in parts 18 which are inserted into an undercut groove of the support frame 1 and are slidingly guided in guiding parts 19 which are also made of plastic and which are retained in an undercut groove of retaining frame 2. FIG. 5 clearly shows the design of the plug in and guiding parts 18,19.

In accordance with FIG. 4, a retaining basket 20 is inserted in the intermediary air space 13 which is provided with two insertion slots for receiving of two transparent panes 21 positioned parallel to the frame plane. Furthermore, the retaining basket 20 engages the glass panes 4 and 8 with cover strips 22 in such a manner that the cover strip 22 can follow a displacement of the retaining frame 2 with respect to the support frame 1.

The structure in accordance with FIG. 6 essentially corresponds to that of FIG. 4. However, the frame connecting elements in this embodiment consist of laminated paper in form of flat plates 23, for example, which can be firmly pressed into a corresponding groove of the support frame 1 with one end, and with the other end form a slide support for the retaining frame 2. FIG. 7 shows such a flat plate 23.

Figure 8:
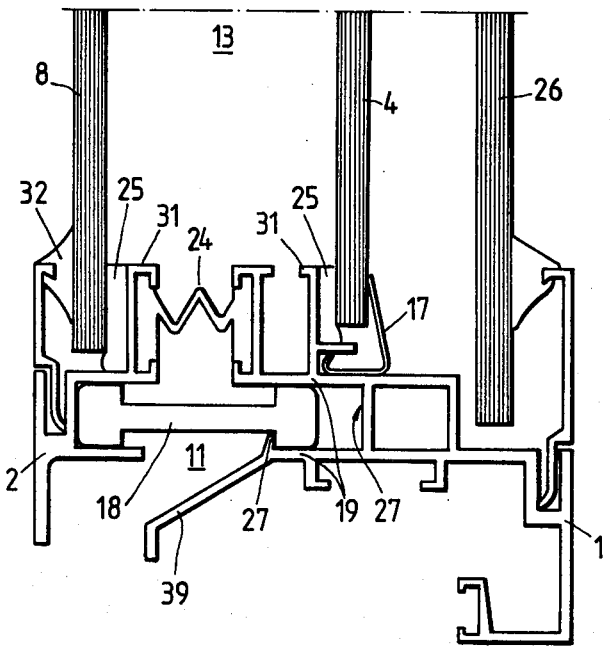

In the embodiment in accordance with FIG. 8 the plug in part 18 which forms the one frame connection element is formed, for example, as a nylon slider which is mounted on the retaining frame 2 and is engaged in a guiding groove of the support frame 1 forming the guiding part 19. A further difference with respect to the other embodiments is to be seen in that the frame sealing profile is now positioned within the frame connecting elements and between the two glass panes 4 and 8. Thereby, the frame sealing profile consists of a pressure spring 24 which is supported on sealing strips 25 by means of glass bars 31, whereby these sealing strips may be adhesive tapes, for example.

Furthermore, in this structure of a window wing, a third glass pane 26 is provided on the inside of the room which is also inserted into the support frame 1, in the same manner as glass pane 4. Furthermore, an abutment 27 is provided on the support frame 1 which limits the maximum displacement path of the retaining frame 2 with respect to the support frame 1 towards outside and inside.

A glass retaining element with a neoprene bar 32 is provided for the weather side positioned glass pane 8 mounted on the retaining frame 2. Furthermore, frame shanks 39 of the support frame 1 form a protective frame which substantially covers the displacement slot 11 between the support frame 1 and retaining frame 2 and thereby also the frame sealing profile 24. At least the lower frame shank 39 which is positioned on the lower side of the frame could be so designed that it is positioned exactly perpendicular with respect to the pane plane and engages the opposite shank of the retaining frame 2 somewhat on the lower side. This results in a centering and support for the retaining frame, so that one could eliminate the additional frame connecting elements (in the embodiment in accordance with FIG. 8, i.e., the plug in part 18 and the guiding part 19). In order to prevent a cold bridge between the frame shank 39 and the retaining frame 2, it would be advantageous that the support frame 2 would support on the frame shanks 39 by means of a thermally insulating forming plastic bar.

Figure 9:
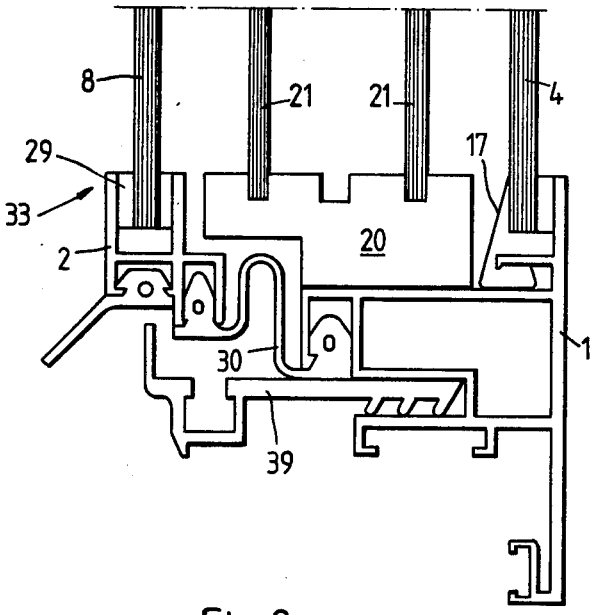
FIGS. 8 to 11 are sectional views of modified embodiments

In the embodiment in accordance with FIG. 9, the frame sealing profile and the frame connecting elements are integrated into one unitary structural element 30. The protective frame 39 is designed separately and is inserted into the support frame 1. A glass retaining element 33 is provided for the weather side glass pane 8 which is formed with a folding groove filled with silicon 29, for example.

Figure 10:
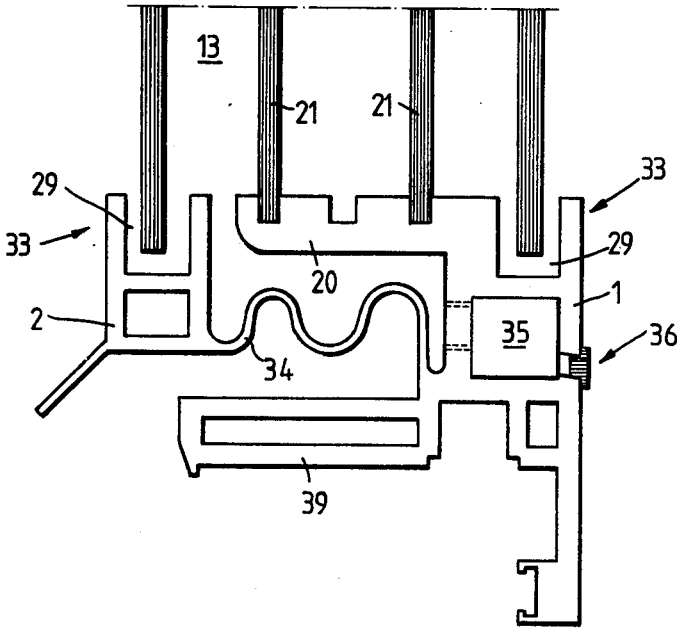

FIG. 10 shows a structure in which the support frame 1, the retaining frame 2, the frame sealing profile, the frame connecting elements as well as the retaining basket 20 for the additional panes 21 are formed by a unitary element 34 which also encompasses the protective frame 39. A circumferential channel 35 is provided in support frame 1, which channel is filled with a moisture retaining flowable material. This channel 35 is a gas exchanging connection with the intermediary air space 13 by means of the openings shown in dashed lines. Furthermore, a discharge opening 36 is provided for channel 35 which is gas tight closed by means of a plug.

Figure 11:
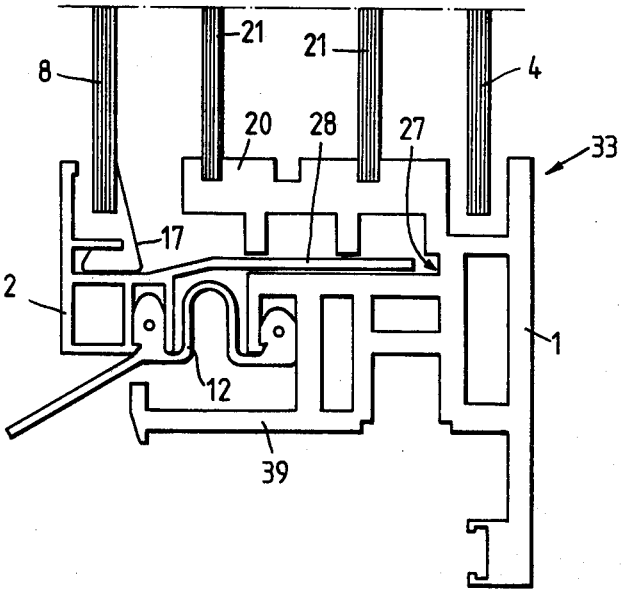

FIG. 11 shows still another embodiment in which the support frame 1, retaining basket 20 and protective frame 39 form a unitary structural element. The retaining frame 2 overlaps with a sliding shank 28 the support frame 1, whereby this sliding shank is displaceably guided between the retaining basket 20 and the support frame 1. The support frame 1 forms an abutment 27 in the sliding direction of the sliding shank 28 for the maximum displacement of the retaining frame 2 against the support frame.

Figure 12:
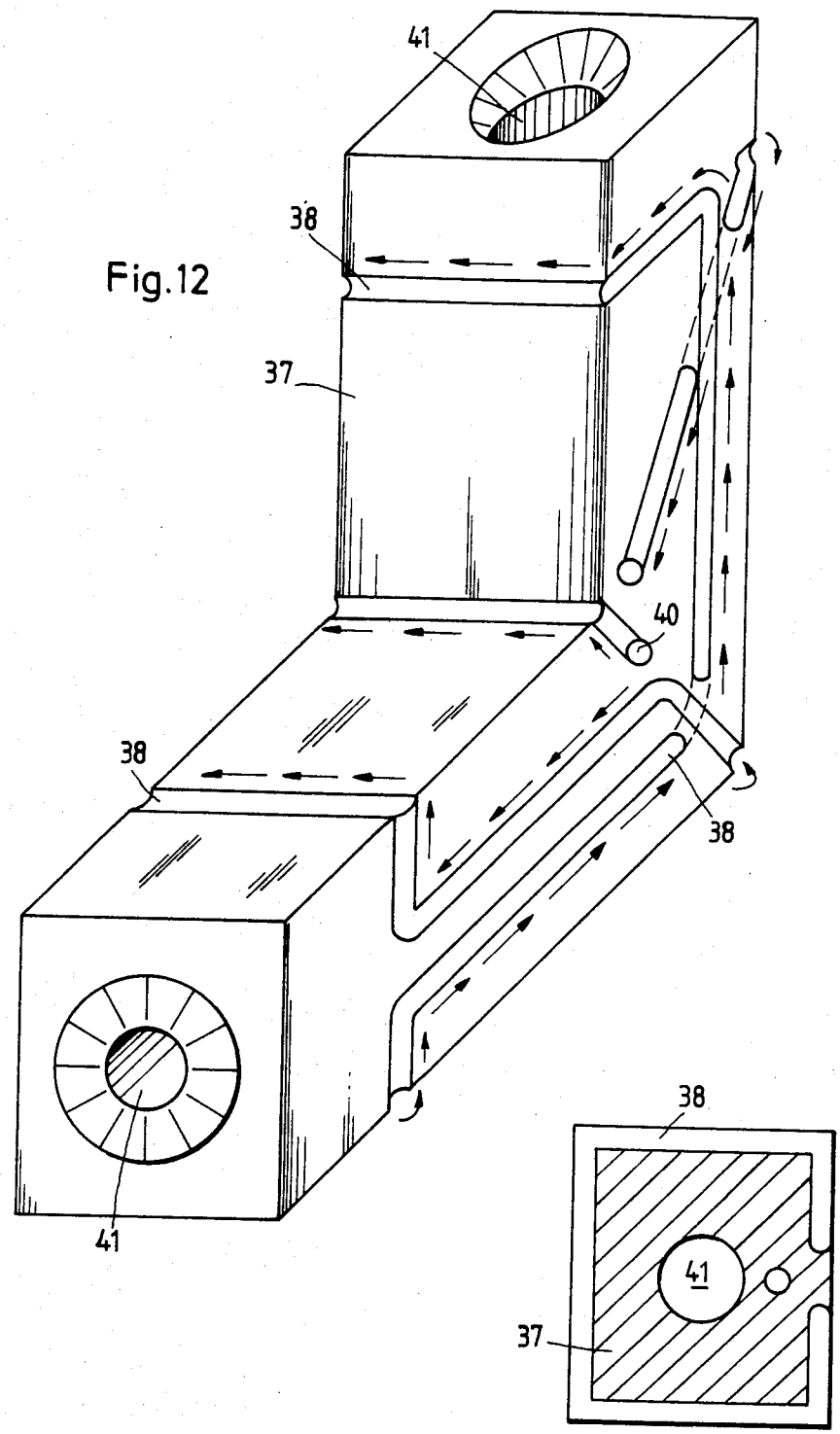
FIG. 12 is a perspective view in an enlarged scale of an angle plate for the frame corners of the support and/or retaining frame.

FIG. 12 shows in an enlarged scale an angle plate 37 which is inserted into the corresponding frame profiles in the corner area of the support frame 1 and/or retaining frame 2. In their jacket faces of this angle plate outwardly extending open sealing grooves (38) are provided which are in connection with an outwardly accessible sealing mass injection opening and an air discharge opening 40. Each of the two shanks of the angle plate should have a circular sealing groove 38 therearound. The angle plate 37 is provided with a bore 41 for forming a closed channel which extends through the retaining or support frame for receiving moisture absorbing material.

I claim:

1. Window or door assembly, comprising a support frame; a retaining frame spaced from said support frame and mounted thereto by frame connecting elements, each of said frames having a frame plane; a multiple insulating glass including at least two glass panes spaced from each other to form an intermediary air space therebetween, the weight of said multiple insulating glass being absorbed by said support frame, said support frame and retaining frame each having a longitudinal bar; at least two pane gaskets each being engaged between the respective glass pane and the respective longitudinal bar, said pane gaskets forming a steam tight closure over a total circumference of the respective glass pane, said connecting elements connecting the frames to each other such that a displacement slot is formed between said frames and the retaining frame at its entire periphery is displaceable relative to the support frame in the direction perpendicular to the frame so that air volume changes of the air between said two panes and pressure fluctuations of the air in outer atmosphere do not cause substantial additional loads in said gaskets and substantial buckling of said panes; and a frame sealing profile positioned between the retaining frame and the support frame so as to bridge said displacement slot between two frames, said profile having an elastic expansion fold and closing said air space between the two glass panes over the total circumference thereof steam tight against outer atmosphere.

2. The assembly as defined in claim 1, wherein said frame sealing profile is a pressure spring.

3. The assembly as defined in claim 2, further including glass bars supporting said pressure spring and engaging with the respective pane gaskets, said pressure spring, said glass bars and said pane gaskets being disposed within said intermediary air space.

4. The assembly as defined in claim 1, further including glass supporting elements respectively supporting said glass panes in the support frame and the retaining frame such as to press the respective glass pane against the associated pane gasket.

5. The assembly as defined in claim 3, further including glass supporting elements respectively supporting said glass panes in the support frame and the retaining frame such as to press the respective glass pane against the associated pane gasket.

6. The assembly as defined in claim 5, wherein the support frame is provided with one of said glass supporting elements to support one of said glass panes and the retaining frame is provided with another of said supporting elements to support another one of said glass panes.

7. The assembly as defined in claim 6, including a frame structure encompassing the retaining frame and the supporting frame, said glass supporting elements being provided in said frame supporting structure.

8. The assembly as defined in claim 7, wherein said glass supporting elements each is formed of a spring bar made of chrome steel and provided with a pressure shank engaged with the respective glass pane at the side thereof facing away from the respective pane gasket.

9. The assembly as defined in claim 6, said glass supporting elements being claws supporting the respective glass panes at the sides thereof facing said air space, under spring tension.

10. The assembly as defined in claim 6, said glass supporting elements being hinges supporting the respective glass panes at the sides thereof facing said air space, under spring tension.

11. The assembly as defined in claim 6, wherein said frame connecting elements are claws.

12. The assembly as defined in claim 6, wherein said frame connecting elements are hinges.

13. The assembly as defined in claim 6, wherein said frame connecting elements are V-shaped spring bars.

14. The assembly as defined in claim 6, wherein said frame connecting elements include a plug-in member engaged with one of said frames and a guide member engaged with another of said frames, said plug-in member being slidably guided in said guide member.

15. The assembly as defined in claim 6, wherein the retaining frame is provided with a sliding shank engaging the support frame in the direction of said displacement.

16. The assembly as defined in claim 6, wherein said frame sealing profile and said frame connecting elements are integrated into one structural unit.

17. The assembly as defined in claim 6, wherein the support frame and said frame sealing profile are integrated into one structural unit.

18. The assembly as defined in claim 6, wherein said support frame is provided with an abutment which limits the maximum displacement of the retaining frame in said direction relative to the support frame.

19. The assembly as defined in claim 6, further including transparent panes disposed in said intermediary air space between said glass panes and positioned parallel thereto.

20. The assembly as defined in claim 19, further including a retaining basket member partially receiving said transparent panes and supporting the same.

21. The assembly as defined in claim 20, wherein said support frame and said retaining basket member are integrated into one structural unit.

22. The assembly as defined in claim 20, wherein said transparent panes are colored.

23. The assembly as defined in claim 20, wherein said transparent panes are provided with coating.

24. The assembly as defined in claim 20, wherein said transparent panes are vapor deposited.

25. The assembly as defined in claim 20, wherein said retaining basket member has cover strips engaging with the respective glass panes and adapted to follow the retainer frame in its displacement relative to the support frame.

26. The assembly as defined in claim 6, including means for evacuating dried air and heavy gas mixtures from the intermediary air space.

27. The assembly as defined in claim 6, wherein a circumferential channel is provided in one of said frames, said channel being filled with a moisture absorbing flowable material and being connected with the intermediary air space in a gas exchanging fashion, said one frame being formed with at least one tight closeable charging and discharging opening communicated with said channel and accessible from outside of the assembly.

28. The assembly as defined in claim 6, further including angle plates inserted into respective corner areas of the retaining frame and the support frame, said angle plates each having an outwardly open sealing groove and an outwardly accessible sealing mass injection opening connected to said groove, and an air discharge opening.

29. The assembly as defined in claim 6, wherein said support frame is formed with a protective frame member which covers the frame sealing profile from outside of the assembly.

30. The assembly as defined in claim 29, wherein said protective frame member forms a support for the retaining frame.

31. The assembly as defined in claim 29, wherein said protective frame member is made of synthetic plastic material.

32. The assembly as defined in claim 29, said support frame including a plurality of frame shanks, said protective frame member being formed by one of said shanks.

33. The assembly as defined in claim 32, further including a thermal insulation means, said one shank displaceably engaging the retaining frame by said thermal insulation means.

34. The assembly as defined in claim 33, wherein said frame protective member has a free edge which forms an abutment for limiting the displacement path of the retaining frame relative to the support frame.

* * * * *